US008336455B2

(12) United States Patent
Ando

(10) Patent No.: US 8,336,455 B2
(45) Date of Patent: Dec. 25, 2012

(54) ROTARY STAMP

(75) Inventor: Masahiro Ando, Neyagawa (JP)

(73) Assignee: Toyoda Co., Ltd., Osaka (JP)

( * ) Notice: Subject to any disclaimer, the term of this patent is extended or adjusted under 35 U.S.C. 154(b) by 240 days.

(21) Appl. No.: 12/994,494

(22) PCT Filed: Jun. 12, 2009

(86) PCT No.: PCT/JP2009/002670

§ 371 (c)(1),
(2), (4) Date: Nov. 24, 2010

(87) PCT Pub. No.: WO2009/153950

PCT Pub. Date: Dec. 23, 2009

(65) Prior Publication Data

US 2011/0072991 A1 Mar. 31, 2011

(30) Foreign Application Priority Data

Jun. 16, 2008 (JP) ..... 2008-182018

(51) Int. Cl.
*B41K 1/02* (2006.01)
*B41K 1/40* (2006.01)
*B41K 1/56* (2006.01)

(52) U.S. Cl. ..... 101/334; 101/327; 101/405

(58) Field of Classification Search ..... 101/103, 101/104, 327, 333, 334, 405, 406, 109; *B41K 1/02, B41K 1/40, 1/54, 1/56*
See application file for complete search history.

(56) References Cited

U.S. PATENT DOCUMENTS 6,129,016 A * 10/2000 Rehkemper et al. ..... 101/327
2010/0326299 A1* 12/2010 Kamiyama et al. ..... 101/333

FOREIGN PATENT DOCUMENTS

JP 49-53817 5/1974
JP 61-148658 U 9/1986
JP 63-170164 U 11/1988
JP 6-67050 U 9/1994

(Continued)

*Primary Examiner* — Leslie J Evanisko
(74) *Attorney, Agent, or Firm* — Birch, Stewart, Kolasch & Birch, LLP

(57) ABSTRACT

Provided is a rotary stamp capable of obtaining an imprint having a uniform density. The rotary stamp includes a sheathing (300) covering an outer side of an upper portion of a leg frame body (1), with a spring (5) interposed therebetween, and being movable upward and downward; and a signet body (2) being movable together with the sheathing (300) and being movable upward and downward with respect to the leg frame body (1). When the sheathing (300) is caused to move downward by exerting a pressing force on the sheathing (300), a stamping face of the signet body (2) makes a half turn and advances to a position where the stamping face is brought into contact with a sealing position. When the sheathing (300) is caused to move upward by releasing the pressing force from the sheathing, the stamping face of the signet body (2) makes an inverse half turn and retracts into the leg frame body (1) to be brought into contact with a vermilion seal ink pad (400) incorporated into the leg frame body (1), in a state where the stamping face is pressed thereagainst. The rotary stamp includes a vermilion seal ink pad rotating mechanism operable to cause the vermilion seal ink pad (400) to rotate by a predetermined angle on a plane orthogonal to a direction in which the signet body (2) advances and retracts, along with upward and downward movements of the sheathing (300) during sealing operation.

4 Claims, 4 Drawing Sheets

FOREIGN PATENT DOCUMENTS

| | | | |
|---|---|---|---|
| JP | 10-297072 | A | 11/1998 |
| JP | 11-34462 | A | 2/1999 |
| JP | 2006-96003 | A | 4/2006 |
| JP | 2007-253487 | A | 10/2007 |

* cited by examiner

FIG.5A
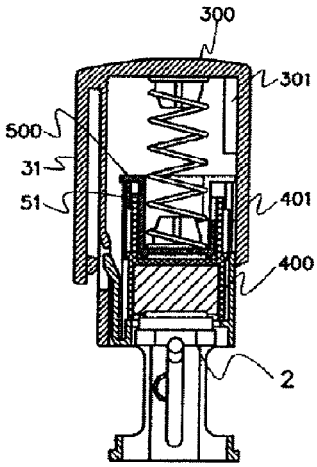
FIG.5B
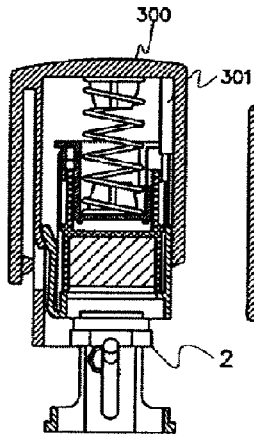
FIG.5C
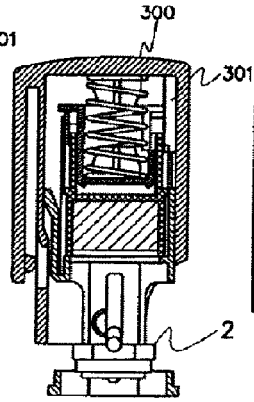
FIG.5D
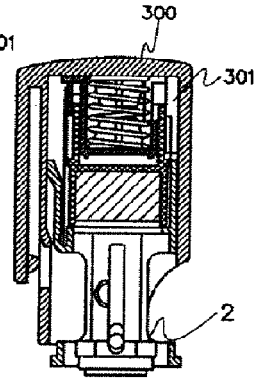
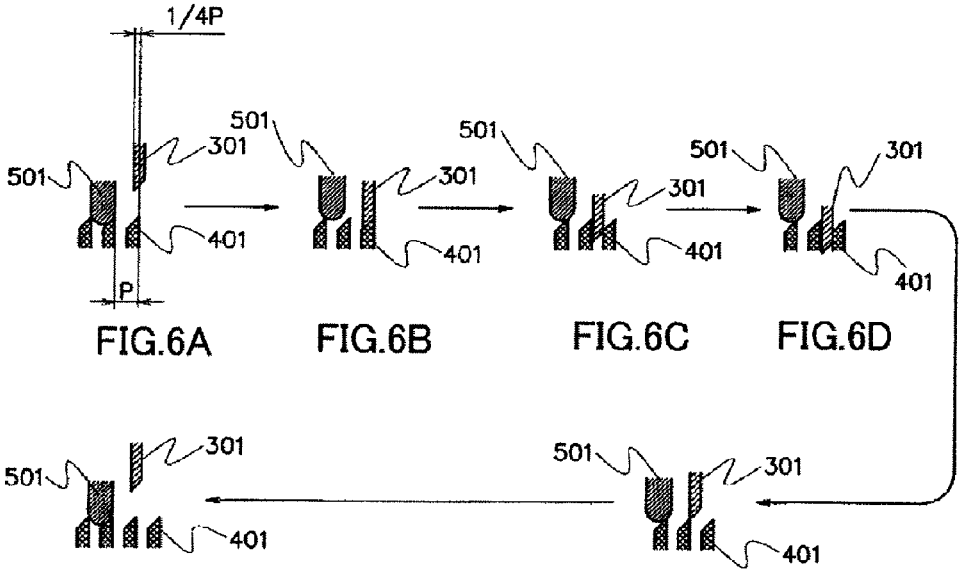
FIG.6A FIG.6B FIG.6C FIG.6D
FIG.6E

ROTARY STAMP

TECHNICAL FIELD

The present invention relates to a rotary stamp, and more particularly, to a rotary stamp including an automatic lock mechanism which allows the rotary stamp to be automatically set in a locked state when the rotary stamp comes to be in an initial state, that is, a liberated state (free state).

Furthermore, the present invention relates to a rotary stamp including a vermilion seal ink pad rotating mechanism which causes a vermilion seal ink pad of the automatic-inking-type rotary stamp to rotate by a predetermined angle for each sealing operation.

BACKGROUND ART

Conventionally, there has been known a signet whose stamping face of a stamping body provided on a lower end of a signet main body and made of a porous body is caused to be in an open state when an outer frame body covering an outer periphery of a leg frame body from above is pressed and descended, the signet main body connected to the outer frame body and arranged inside the leg frame body is thereby descended, and moving in response thereto, a lid body pivotally fitted to the leg frame body is rotated. The above mentioned signet is disclosed, for example, in Japanese Utility Model Application Laid-Open Publication No. 6-67050 (Patent Literature 1). In general, this kind of a signet has a structure in which by pressing and descending the outer frame body integrated with an inner casing body holding the signet main body, the signet main body is descended inside a leg frame body and moving in response thereto, the lid body is rotated, thereby exposing the stamping face from a lower end opening of the leg frame body and allowing sealing. It is often the case that this kind of a signet is put into a pocket of clothing or a bag and carried. However, when against a user's intention, a pressing force which descends the outer frame body is exerted while such a signet is being carried in the above-mentioned manner, the signet main body is descended and the lid body with a lid in a closed state is rotated, thereby leading to a problem that the stamping face is exposed and stuff in a pocket and a bag or clothing is stained with ink.

Hence, as those which solve the above-mentioned problem, there have been stamp (or seal) holders disclosed in Japanese Patent Application Laid-Open Publication No. 10-297072 (Patent Literature 2) and Japanese Patent Application Laid-Open Publication No. 11-34462 (Patent Literature 3); and a signet (or stamp) disclosed in Japanese Patent Application Laid-Open Publication No. 2006-96003 (Patent Literature 4). Each of these stamp holders and signet disclosed therein is provided with a lock mechanism which prevents a signet main body from descending. In the stamp holder disclosed in Japanese Patent Application Laid-Open Publication No. 10-297072 (Patent Literature 2), it is required to perform locking and unlocking by means of a seesaw-type lock button. In the stamp holder disclosed in Japanese Patent Application Laid-Open Publication No. 11-34462 (Patent Literature 3), it is required to perform locking and unlocking by means of a slide button. In the signet disclosed in Japanese Patent Application Laid-Open Publication No. 2006-96003 (Patent Literature 4), it is required to perform locking and unlocking by rotating an outer frame body.

On the other hand, the automatic-inking-type rotary stamp as disclosed in Japanese Utility Model Application Laid-Open Publication No. 63-170164 (Patent Literature 5), that is, a rotary stamp whose stamping face of a stamping plate makes a half turn and advances to a position, where the stamping face is brought into contact with a target to be pressed, when a pressing force is exerted on an outer cylinder and whose stamping face thereof makes an inverse half turn and retracts so as to be brought into contact with a vermilion seal ink pad provided inside an inner cylinder when the pressing force is released is widely used for business purposes in banks, insurance companies, and the like.

CITATION LIST

Patent Literature

Patent Literature 1: Japanese Utility Model Application Laid-Open Publication No. 6-67050

Patent Literature 2: Japanese Patent Application Laid-Open Publication No. 10-297072

Patent Literature 3: Japanese Patent Application Laid-Open Publication No. 11-34462

Patent Literature 4: Japanese Patent Application Laid-Open Publication No. 2006-96003

Patent Literature 5: Japanese Utility Model Application Laid-Open Publication No. 63-170164

SUMMARY OF THE INVENTION

Technical Problem

In a case where seals are successively put by using the automatic-inking-type rotary stamp, because the stamping face of the signet is brought into contact with the same portion of the vermilion seal ink pad, adhesion of vermilion seal ink becomes partially poor, thereby leading to a problem that an imprint having a uniform density cannot be obtained.

In addition, in any of the conventional technologies, locking is performed through a user's operation. Therefore, extra work for such an operation is required, and in a case where performing such an operation is forgotten, because the stamping face remains exposed, a disastrous consequence that stuff in a pocket and a bag or clothing is stained with ink is likely to be incurred.

Therefore, one object of the present invention is to provide a rotary stamp capable of obtaining an imprint having a uniform density.

In addition, another object of the present invention is to provide a rotary stamp which needs no locking operation and is capable of preventing the consequence that the stamping face is exposed and the clothing or the like is thereby stained from being likely to be incurred.

Solution To Problem

A rotary stamp according to the present invention comprises: a sheathing covering an outer side of an upper portion of a leg frame body, with a spring interposed therebetween, and being movable upward and downward; and a signet body being movable together with the sheathing and being movable upward and downward with respect to the leg frame body, the rotary stamp operable to perform sealing by positioning a lower end of the leg frame body at a position where a seal is put and by moving the sheathing downward. In the rotary stamp, when the sheathing is caused to move downward by exerting a pressing force on the sheathing, a stamping face of the signet body makes a half turn and advances to a position where the stamping face is brought into contact with a sealing position; and when the sheathing is caused to move upward by releasing the pressing force from the sheathing, the stamping face of the signet body makes an inverse half turn and retracts into the leg frame body to be brought into contact with a vermilion seal ink (cinnabar seal ink) pad incorporated into the leg frame body, in a state where the stamping face is pressed thereagainst. In the rotary stamp, included is a vermilion seal ink pad rotating mechanism operable to cause the vermilion seal ink (cinnabar seal ink) pad to rotate by a predetermined angle on a plane orthogonal to a direction in which the signet body advances and retracts, along with upward and downward movements of the sheathing during sealing operation. Since this allows the stamping face of the signet body not to contact the same portion of the vermilion seal ink pad, partial blurring of the vermilion seal ink (cinnabar seal ink) is avoided, thereby enhancing quality of an automatic seal.

In the rotary stamp according to the present invention, it is preferable that the vermilion seal ink pad rotating mechanism includes: an active rib, provided on an inner peripheral wall of an upper portion of the sheathing, for imparting a rotating force to the vermilion seal ink pad through performing a sealing operation (that is, through moving the sheathing downward); passive ribs provided on an entire outer periphery of the vermilion seal ink pad with each pitch of a predetermined angle so as to stand head to head with the active rib; a spring receptacle being of a cylindrical shape having a bottom and provided in a space inside the upper portion of the vermilion seal ink pad so as not to rotate with respect to the sheathing or the leg frame body and so as to be movable upward; fitting (engagement) ribs each fitted (or engaged) between the passive ribs and provided on an outer peripheral portion (for example, an underside or an outer peripheral face of a brim) of the spring receptacle; and a spring, provided in the spring receptacle, for imparting an urging force in a downward movement direction. It is preferable that a mutual rib relationship (for example, a position and a shape of each of the ribs) is set such that each of the passive ribs of the vermilion seal ink pad is rotated by substantially three quarters of a pitch by a downward movement of the active rib along with a downward movement of the sheathing; and a succeeding one of the passive ribs is rotated by substantially a quarter of a pitch by a downward movement of the fitting (or engagement) ribs, caused by the urging force of the spring in a process of an upward movement of the sheathing.

On the other hand, in order to address the problem that a disastrous consequence is likely to be incurred in a case where a locking operation is forgotten, it is preferable that the rotary stamp according to the present invention includes an automatic lock mechanism operable to set a locked state where the sheathing is prevented from moving downward when the sheathing is caused to move upward by the urging force of the spring.

Advantageous Effects of the Invention

In a rotary stamp according to the present invention, a vermilion seal ink (cinnabar seal ink) pad is rotated by a predetermined angle, whereby even in a case where a large number of seals are successively put, imprints each having an uniform density of vermilion seal ink (cinnabar seal ink) can be obtained.

Furthermore, since a rotary stamp including an automatic lock mechanism is automatically set to be in a locked state when the rotary stamp returns to an initial state, that is, a free state after finishing the sealing operation, not only no locking operation is needed but also there brought about is an advantage that it is unlikely that against a user's intention, a stamping face is exposed and thereby, clothing or the like is stained.

BRIEF DESCRIPTION OF THE DRAWINGS

FIG. 5 shows views A, B, C, and D, illustrating motions of a sealing operation performed by the rotary stamp as the second embodiment of the present invention.

FIG. 6 shows views A, B, C, D, and E, illustrating motions in a rib relationship in the rotary stamp as the second embodiment of the present invention.

DESCRIPTION OF EMBODIMENTS

Hereinafter, embodiments of the present invention will be described with reference to the accompanying drawings.

First Embodiment

First, described is an embodiment in which a rotary stamp that is automatically set in a locked state when the rotary stamp returns to an initial state, that is, a free state after finishing a sealing operation is realized by the minimum number of parts.

Figure 1A:
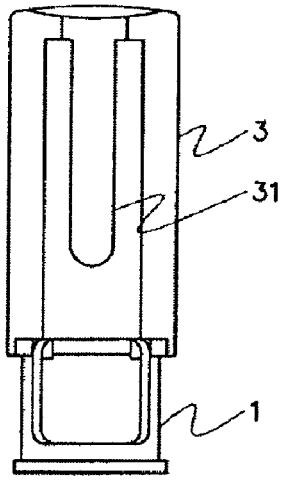
FIG. 1 shows a front view A, a side view B, and a perspective view C, illustrating a rotary stamp as a first embodiment of the present invention.
Figure 1B:
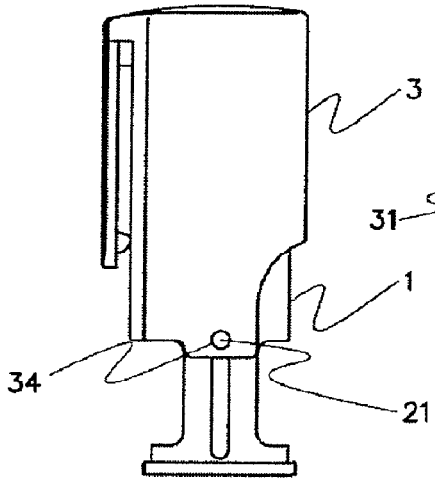
Figure 1C:
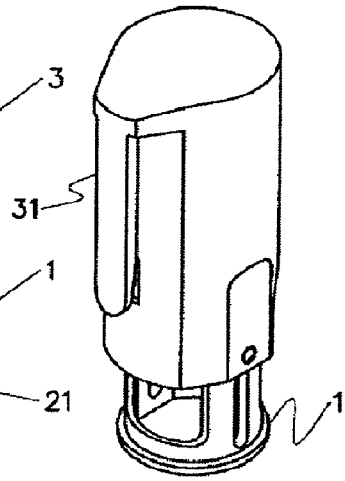
Figure 2A:
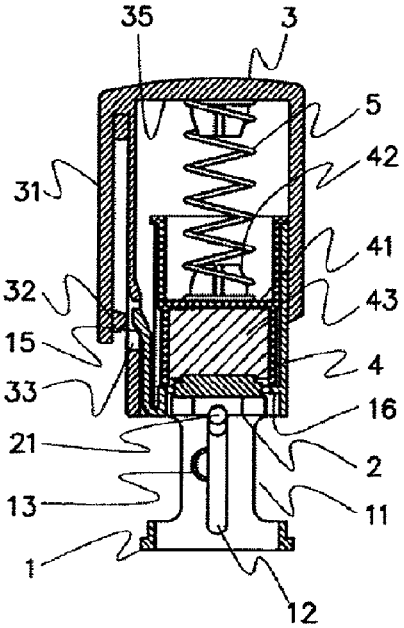
FIG. 2 shows views A, B, and C, illustrating motions of a sealing operation performed by the rotary stamp as the first embodiment of the present invention.
Figure 2B:
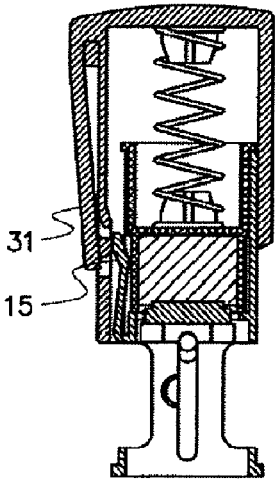
Figure 2C:
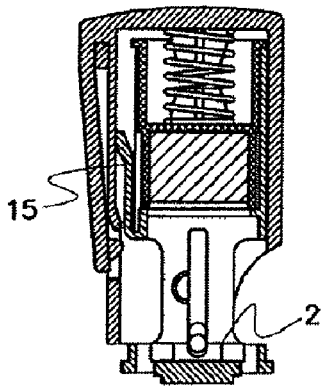
Figure 3:
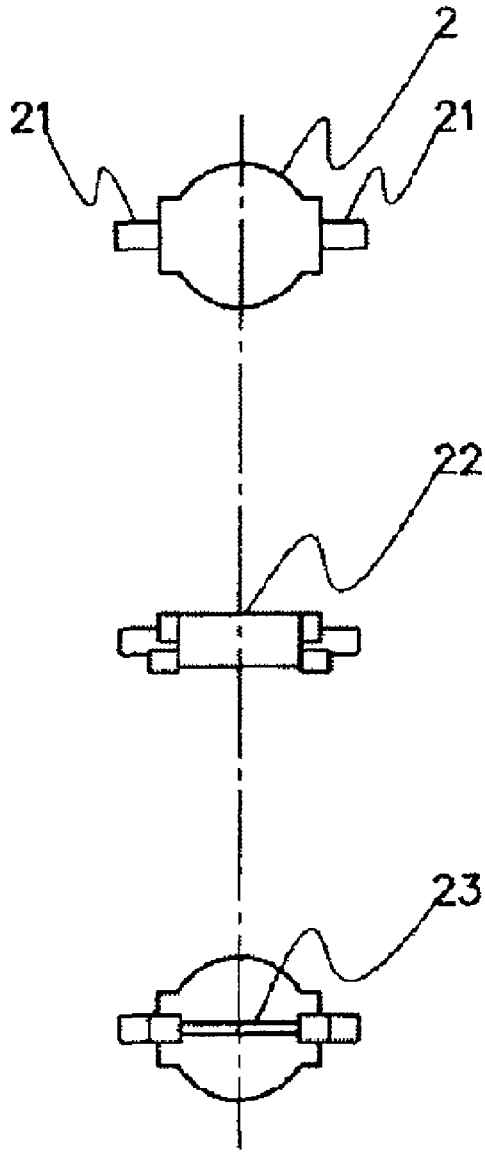
FIG. 3 is an external view, illustrating a signet body of the rotary stamp as the first embodiment of the present invention.

FIG. 1 through FIG. 3 show the first embodiment of the present invention. FIG. 1 A, FIG. 1 B, and FIG. 1 C are a front view, a right side view, and an appearance perspective view, respectively, illustrating an appearance of the rotary stamp according to the present invention. FIG. 2 are vertical cross-sectional views, illustrating a state transition occurring by performing a sealing operation. FIG. 3 is a view, illustrating an appearance of a signet body (a top face, a front face, and a bottom face).

A leg frame body 1 which is made of plastic and is hollow-column-shaped has openings on upper and lower end faces thereof and is provided with window parts 11, for assembling the signet body 2, on front and rear faces thereof. In addition, these window parts 11 serve to perform accurate positioning upon sealing and contribute to a reduction in a weight of the rotary stamp.

Furthermore, on right and left side faces thereof which are orthogonal to the window parts 11, slits 12 for moving the signet body 2 upward and downward upon sealing are provided in a vertical direction. On central portions of the front lateral ends of the slits 12, a rib 13, which is semicircular-arc-shaped and thin, for inverting the signet body 2 along with the upward and downward movement of the signet body 2 is provided.

On a front lateral face of a central portion of the leg frame body 1, a latch piece 15 which engages with a sheathing 3 and thereby prevents the sheathing 3 from moving downward is provided so as to have resilience, the latch piece 15 integrally molded. A rib-shaped pedestal 16 determines a position of a vermilion seal ink pad 4 in a downward direction.

As shown in FIG. 3, the signet body 2 is a substantially-disc-shaped body made of plastic and has a rotation axis 21 horizontally arranged. On a face thereof which is not a stamping face 22, a rib 23 which reinforces the rotation axis 21 is provided.

As shown in FIG. 1, the sheathing 3 is a cap body made of plastic and having a clip 31, is placed so as to cover an outer side of an upper portion of the leg frame body 1, and moves upward and downward.

On an inner side of a leading end portion (a lower end portion) of the clip 31, a protrusion 32 which is hemispherical is provided. On a peripheral wall of the sheathing 3, which the protrusion 32 faces, an opening 33 with which the latch piece 15 of the leg frame body 1 engages is provided. The clip 31 has resilience and is integrally molded. By inwardly pressing the clip 31, the latch piece 15 is inwardly deformed, whereby the clip 31 functions to release the engagement of the latch piece 15 and the opening 33. In addition, as a matter of course, the clip 31 serves as a clip used when the rotary stamp is attached to a pocket of clothing or the like (like a clip provided on a cap of a fountain pen).

Furthermore, the sheathing 3 is provided with bearing holes 34, on lower end portions of the peripheral wall thereof, through which the rotation axis 21 of the signet body 2 is inserted, the rotation axis 21 piercing the slits 12 of the leg frame body 1.

In an inside space of the upper portion of the leg frame body 1, the vermilion seal ink pad 4 which has a partition wall 41 in a central position between the top and the bottom of an inside thereof and is composed of a cylindrical body made of plastic is fitted by insertion. Between an upper face of the partition wall 41 of the vermilion seal ink pad 4 and a lower face of a ceiling wall 35 of the sheathing 3, a spring 5 is interposed. In addition, a space of a lower portion of the vermilion seal ink pad 4 is filled with an ink pad 43. Note that a rib 42 determines a position of the spring 5, and a rib similar thereto is provided also on a lower face of the ceiling wall 35 of the sheathing 3.

Assembly of the rotary stamp composed of the above-mentioned components is completed in the following manner: the rotation axis 21 of the signet body 2 is obliquely tilted and inserted into the slits 12 of the leg frame body 1; the vermilion seal ink pad 4 is inserted into the space of the upper portion of the leg frame body 1; further, with the spring 5 mounted on the upper face of the partition wall 41 of the vermilion seal ink pad 4, the sheathing 3 is placed thereon from above and moved downward while the latch piece 15 of the leg frame body 1 is being inwardly pressed; and the rotation axis 21 of the signet body 2 is inserted into the bearing holes 34 of the sheathing 3 in a forcibly fitted manner. Upon assembling the rotary stamp, the stamping face (seal character(s)) of the signet body 2 is oriented such that a side of an initial character (on an upper side) is located so as to face toward the clip 31 of the sheathing 3 upon sealing. This is to allow correctly oriented sealing to be automatically performed when sealing is performed with an index finger attached at the clip 31 of the sheathing 3, avoiding cares about the orientation of the stamping face (seal character(s)) upon sealing.

Next, usage of the rotary stamp, according to the present embodiment, structured as described above will be described. As shown in FIG. 2 A, in the liberated state (free state), the sheathing 3 is located in an upper position by an urging force of the spring 5, the rotation axis 21 of the signet body 2 is ascended and located on an upper end side of the slits 12 of the leg frame body 1, the stamping face 22 of the signet body 2 is pressed against the ink pad 43, and also, the latch piece 15 of the leg frame body 1 and the opening 33 of the sheathing 3 are engaged with each other, thereby setting the rotary stamp to be in a locked state in which the sheathing 3 is prevented from moving downward.

As shown in FIG. 2 B, in a case where sealing is performed, the leading end portion (lower end portion) of the clip 31 of the sheathing 3 is pressed with an index finger; the locked state is released by inwardly deforming the latch piece 15 of the leg frame body 1; thereafter, a leading end (lower end) of the leg frame body 1 is positioned at a position where a seal is put; and as shown in FIG. 2 C, by moving (pressing) the sheathing 3 downward, the signet body 2 is inverted while moving downward, thereby performing the sealing. Since the above-described "structure and motions in which the signet body 2 is inverted while moving downward" have been implemented since the beginning of the Showa Period and this technology is well-known for those skilled in the art, the description thereof will be omitted (as reference examples of the automatic-inking-type rotary stamp, Japanese Utility Model Application Laid-Open Publication No. 61-148658 and Japanese Utility Model Application Laid-Open Publication No. 63-170164 are adduced).

The force (pressing force) pressing down the sheathing 3 is released after finishing the sealing, whereby the liberated state (free state) shown in FIG. 2 A is set by the urging force of the spring 5; and the latch piece 15 of the leg frame body 1 and the opening 33 of the sheathing 3 are engaged with each other, whereby the locked state in which the sheathing 3 is prevented from moving downward is set. Thus, the situation where a locking operation is forgotten does not occur and the consequence that against a user's intention, the stamping face is exposed and clothing or the like is stained is avoided.

The above-described automatic lock mechanism is structured by providing the leg frame body with the latch piece which prevents the sheathing from moving downward through the engagement with the sheathing and also by providing the sheathing with the releasing means (the clip in the above-described embodiment) which releases the engagement by displacing the latch piece. The above-mentioned upward and downward movements are performed in a motion direction in a standard sealing operation (operation in which the sealing is performed on a horizontal face from above). However, needless to say, it is not interpreted that the rotary stamp according to the present invention is limited to a rotary stamp used in the standard sealing operation.

The rotary stamp according to the present invention may be each of the stamp holders as disclosed in Japanese Patent Application Laid-Open Publication No. 10-297072 and Japanese Patent Application Laid-Open Publication No. 11-34462 and may be a signet which includes a stamping body composed of a porous body having a myriad of continuous pores and is capable of successively performing sealing, the signet descending inside a leg frame body while moving together with a sheathing. In other words, provided that a signet is provided with a lock mechanism which prevents a signet from descending, the present invention may be applicable to any type of signets.

In addition, the above-mentioned releasing means may be releasing means in which a push button which has a projecting shape and whose top part pierces a peripheral wall of a sheathing is interposed between the sheathing and a latch piece. However, it is preferable that the releasing means is formed of a clip for holding the rotary stamp to clothing or the like, as in the above-described embodiment. In a case where the sheathing is formed of plastic, by molding the clip so as to be integrated with the sheathing, the number of parts is reduced and assembling workability is also enhanced. Furthermore, it is preferable that the releasing means is provided in a position associated with the orientation of the upper side of the stamping face, thereby enhancing sealing workability.

Furthermore, the above-described automatic lock mechanism may be structured by providing the sheathing with the latch piece which prevents the sheathing from moving downward through the engagement with the leg frame body and also by providing the sheathing with the releasing means which displaces the latch piece and releases the above-mentioned engagement. It is preferable that the releasing means in this case is a lock releasing button having a seesaw-type lever with which the latch piece is displaced (lifted).

In the above-described embodiment, even if an external force is temporarily exerted on the clip as one example of the releasing means, unless an external force in a sealing operation direction is concurrently exerted, it does not occur that the stamping face is exposed and clothing or the like is stained due to the exposure of the stamping face.

By forming the clip as the releasing means, even if an external force is exerted on the releasing means in a state where the clip is held to a pocket of clothing or the like, it is unlikely that the locked state is released, allowing the rotary stamp to be used in a carefree manner.

In addition, the releasing means specifies the orientation of the stamping face upon sealing (determines the upper side of the stamping face), an imprint having no inclination can be obtained in an unintentional manner.

Second Embodiment

Next, as a second embodiment of the present invention, "an automatic-inking-type rotary stamp comprising: a sheathing covering an outer side of an upper portion of a leg frame body, with a spring interposed therebetween, and being movable upward and downward; and a signet body being movable together with the sheathing and being movable upward and downward with respect to the leg frame body, wherein when the sheathing is caused to move downward by exerting a pressing force on the sheathing, a stamping face of the signet body makes a half turn and advances to a position where the stamping face is brought into contact with a sealing position; and when the sheathing is caused to move upward by releasing the pressing force from the sheathing, the stamping face of the signet body makes an inverse half turn and retracts into the leg frame body to be brought into contact with a vermilion seal ink (cinnabar seal ink) pad incorporated into the leg frame body, and the rotary stamp includes a vermilion seal ink pad rotating mechanism which causes the vermilion seal ink (cinnabar seal ink) pad to rotate by a predetermined angle on a plane orthogonal to a direction in which the signet body advances and retracts, along with the upward and downward movements of the sheathing during sealing operation" will be described with reference to the accompanying drawings.

Figure 4A:
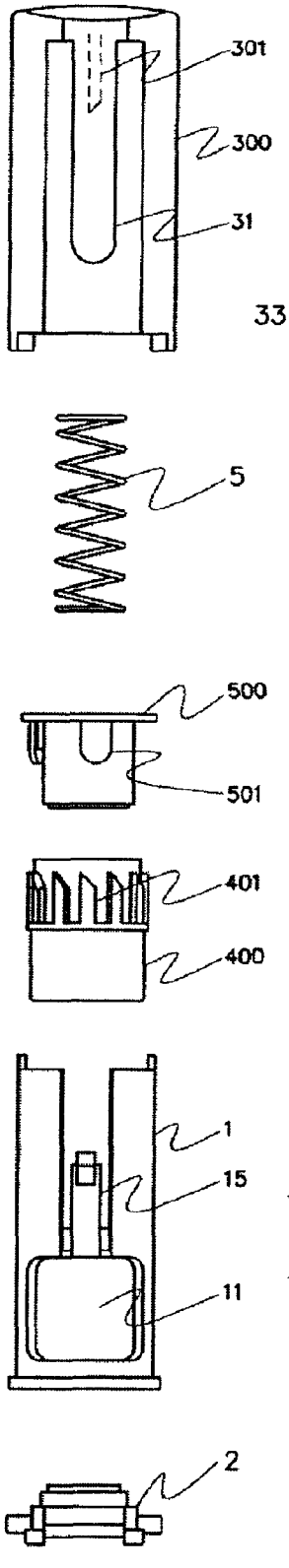
FIG. 4 shows an exploded front view A, an exploded cross-sectional view B, and an exploded perspective view C, illustrating a rotary stamp as a second embodiment of the present invention.
Figure 4B:
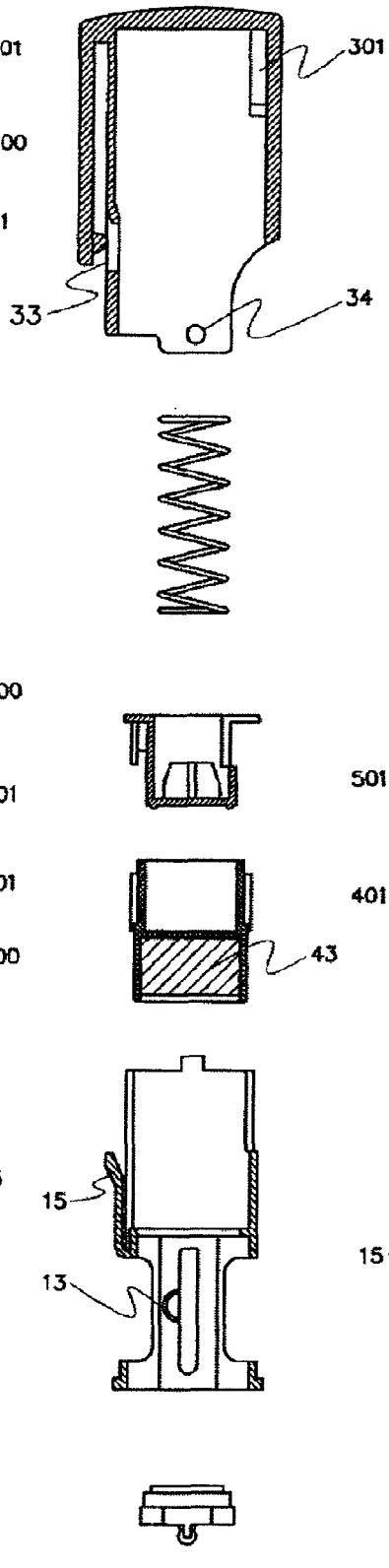
Figure 4C:
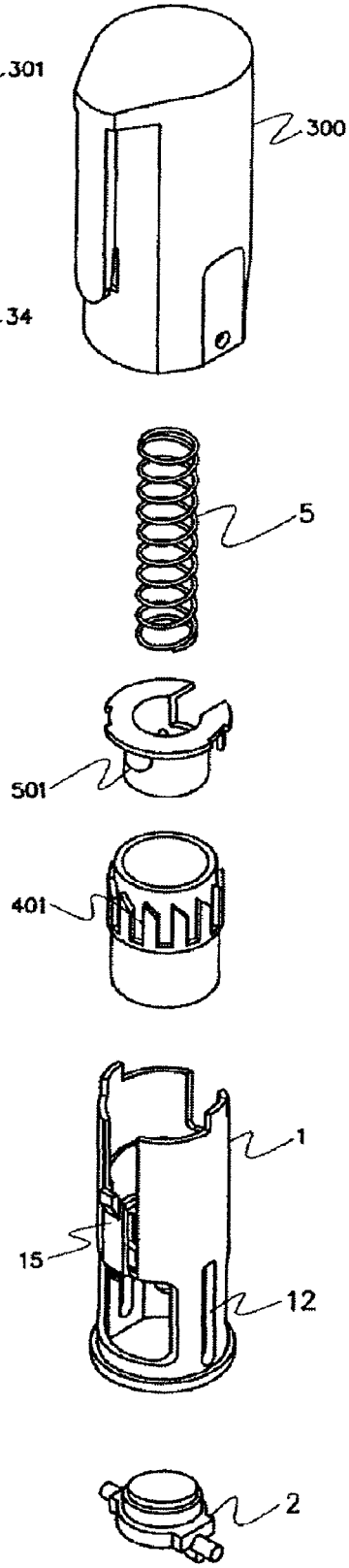

FIG. 4 through FIG. 6 show the second embodiment of the present invention. FIG. 4 A, FIG. 4 B, and FIG. 4 C are a front view (exploded front view), a right side cross-sectional view (exploded side cross-sectional view), and an appearance perspective view (exploded perspective view), respectively, illustrating appearances of components of the rotary stamp according to the present invention. FIG. 5 are vertical cross-sectional views, illustrating a state transition occurring by performing a sealing operation. FIG. 6 are views, illustrating operations of essential parts of a rotating mechanism in a sealing process.

Here, the same parts as or the corresponding to those in the above-described first embodiment are denoted by the same reference numerals, the descriptions thereof will be omitted, and only parts different from those in the first embodiment will be described. In the second embodiment, the rotary stamp according to the present invention, which includes the rotating mechanism operable to cause the vermilion seal ink pad to rotate by the predetermined angle on the plane orthogonal to the direction in which the signet body advances and retracts, will be described.

In the rotating mechanism, an active rib 301 for imparting a rotating force to the vermilion seal ink pad 400 by causing the sheathing 300 to perform a sealing operation (to move downward) is provided on an inner peripheral wall of an upper portion of the sheathing 300. This active rib 301 has an inclined plane, on a tip thereof, on a side toward which the vermilion seal ink pad 400 is rotated. A thickness dimension of the rib in a rotation direction is made slightly smaller than one-half of a rotation pitch so as to allow the rib to enter each space between passive ribs. In the present embodiment, one active rib 301 is provided in a position which is point-symmetrical with respect to a position of a clip 31, that is, a position rotated by 180 degrees from the position of the clip 31 (of course, a plurality thereof may be provided).

Passive ribs 401 are provided on an outer periphery of an upper portion of the vermilion seal ink pad 400 with each pitch of a predetermined angle (which is an angle of one integer-th of 360 degrees) so as to stand head to head with the active rib 301. Each of these passive ribs 401 has an inclined plane on a side opposite to the side toward which the vermilion seal ink pad 400 is rotated, and a thickness dimension of each of these ribs in the rotation direction is one-half of the rotation pitch. As shown in FIG. 6 A, in a positional relationship between one of these passive ribs 401 and the active rib 301 in the rotation direction, the one of the passive ribs 401 is located substantially a quarter of a pitch ahead of the active rib 301 (substantially a half of the active rib 301 overlaps the one of the passive ribs 401, viewed from above in a projected manner).

Furthermore, in a space inside the upper portion of the vermilion seal ink pad 400, a spring receptacle 500 which has a brim and is of a cylindrical shape having a bottom is provided so as not to rotate with respect to the sheathing 300 or the leg frame body 1. On an underside of the brim of this spring receptacle 500, three fitting (engagement) ribs 501, each of which is fitted (engaged) between the passive ribs 401 and 401, are provided so as to allow spacings, each of which is an integral multiple of a pitch (for example, a spacing of 120 degrees). In other words, only the vermilion seal ink pad 400 sandwiched between the leg frame body 1 and the spring receptacle 500, which do not rotate, is allowed to rotate. A width dimension of each of the fitting ribs 501 in the rotation direction is equal to the rotation pitch (it is not necessarily to be equal thereto), and a tip of each of the fitting ribs 501 is arc-shaped so as to be fitted (engaged) between the passive ribs 401 and 401 which neighbor each other.

Next, an operation of the rotating mechanism in the sealing process will be described with reference to views illustrating operating states in FIG. 5 and to rib-related operation explanatory views illustrating "an operational relationship among the active rib 301, the passive ribs 401, and the fitting rib 501" in FIG. 6.

In a liberated (free) state shown in FIG. 5 A before performing sealing, the active rib 301 and the passive rib 401 are apart from each other as shown in FIG. 6 A, and the fitting rib 501 is fitted (engaged) between the neighboring passive ribs 401 and 401 by an urging force of a spring 5.

A leading end portion (lower end portion) of the clip 31 of the sheathing 300 is pressed with an index finger; a locked state is released by inwardly deforming the latch piece 15 of the leg frame body 1; thereafter, a leading end (lower end) of the leg frame body 1 is positioned at a position where a seal is put; and by moving (pressing) the sheathing 300 downward as shown in FIG. 5 B, the inclined plane of the active rib 301 presses the inclined plane of the passive rib 401 as shown in FIG. 6 B and thereby, the vermilion seal ink pad 400 is started to rotate in a right direction (a rotation direction is left). In FIG. 6 B, the passive rib 401 is rotated by substantially a quarter of a pitch, and the fitting rib 501 is pushed up by the passive rib 401 located two pitches behind. The fitting rib 501 is pushed up and thereby, the spring receptacle 500 is slightly lifted, whereby the vermilion seal ink pad 400 is rendered in a state where the vermilion seal ink pad 400 easily rotates.

By further moving the sheathing 300 downward as shown in FIG. 5 C, the inclined plane of the active rib 301 completely pushes away the inclined plane of the passive rib 401 as shown in FIG. 6 C, and thereby, the vermilion seal ink pad 400 is rotated by substantially three quarters of a pitch, whereby a central position (the lowest end) of the fitting rib 501 comes to be in a state where the central position thereof is substantially a quarter of a pitch beyond a summit of the passive rib 401 located two pitches behind.

In a state, shown in FIG. 5 D, where a seal has been put, the active rib 301 merely enters a gap between the passive rib 401 and the succeeding passive rib 401 and the rotation comes to be in a stop state.

After finishing the sealing, by moving the sheathing 300 upward, the active rib 301 exits out of the gap between the passive rib 401 and the succeeding passive rib 401 as shown in FIG. 6 E, and the rotation is maintained in the stop state.

By further moving the sheathing 300 upward, the active rib 301 has completely exited out of the gap between the passive rib 401 and the succeeding passive rib 401 and is separated therefrom, the spring receptacle 500 which has been lifted up is pressed down by an urging force of the spring 5, and the fitting rib 501 is fitted between the passive rib 401 located two pitches behind and the passive rib 401 located three pitches behind, whereby the vermilion seal ink pad 400 is rotated by substantially a quarter of a pitch and the same liberated (free) state shown in FIG. 6 A returns. As a result, by performing the sealing operation once, the vermilion seal ink pad 400 is rotated by one pitch.

Since in the rotary stamp according to the present invention, the vermilion seal ink pad 400 is rotated by one pitch (the predetermined angle), even when the sealing is successively performed a multitude of times, imprints each having a uniform density of vermilion seal ink (cinnabar seal ink) can be obtained.

The described embodiments are to be considered in all respects only as illustrative and not restrictive. It is intended that the scope of the invention is, therefore, indicated by the appended claims rather than the foregoing description of the embodiments and that all modifications and variations coming within the meaning and equivalency range of the appended claims are embraced within their scope.

INDUSTRIAL APPLICABILITY

Since a rotary stamp according to the present invention includes a vermilion seal ink (cinnabar seal ink) pad rotating mechanism, even in a case where a large number of seals are successively put, imprints each having a uniform density of vermilion seal ink (cinnabar seal ink) can be obtained, and the present invention is applicable to a rotary stamp having an automatic lock function which allows the rotary stamp to be automatically set in a locked state when the rotary stamp is in a liberated (free) state.

REFERENCE SIGNS LIST

1 leg frame body
15 latch piece (lock means)
2 signet body
3, 300 sheathing
31 clip (lock releasing means)
33 opening (lock means)
301 active rib
4, 400 vermilion seal ink pad
401 passive rib
5 spring
500 spring receptacle
501 fitting rib

The invention claimed is:

1. A rotary stamp comprising: a sheathing (300) covering an outer side of an upper portion of a leg frame body (1), with a spring (5) interposed therebetween, and being movable upward and downward; and a signet body (2) being movable together with the sheathing (300) and being movable upward and downward with respect to the leg frame body (1), the rotary stamp operable to perform sealing by positioning a lower end of the leg frame body (1) at a position where a seal is put and by moving the sheathing (300) downward, wherein when the sheathing (300) is caused to move downward by exerting a pressing force on the sheathing (300), a stamping face of the signet body (2) makes a half turn and advances to a position where the stamping face is brought into contact with a sealing position; and when the sheathing (300) is caused to move upward by releasing the pressing force from the sheathing, the stamping face of the signet body (2) makes an inverse half turn and retracts into the leg frame body (1) to be brought into contact with a vermilion seal ink pad (400) incorporated into the leg frame body (1), in a state where the stamping face is pressed thereagainst, and the rotary stamp comprises a vermilion seal ink pad rotating mechanism operable to cause the vermilion seal ink pad (400) to rotate by a predetermined angle on a plane orthogonal to a direction in which the signet body (2) advances and retracts, along with upward and downward movements of the sheathing (300) during sealing operation.

2. The rotary stamp according to claim 1, wherein the vermilion seal ink pad rotating mechanism includes:

an active rib (301), provided on an inner peripheral wall of an upper portion of the sheathing (300), for imparting a rotating force to the vermilion seal ink pad (400) through performing a sealing operation;

passive ribs (401) provided on an entire outer periphery of the vermilion seal ink pad (400) with each pitch of a predetermined angle so as to stand head to head with the active rib (301);

a spring receptacle (500) being of a cylindrical shape having a bottom and provided in a space inside the upper portion of the vermilion seal ink pad (400) so as not to rotate with respect to the sheathing (300) or the leg frame body (1) and so as to be movable upward;

fitting ribs (501) each fitted between the passive ribs (401) and provided on an outer peripheral portion of the spring receptacle (500); and a spring (5), provided in the spring receptacle (500), for imparting an urging force in a downward movement direction, wherein a mutual rib relationship is set such that each of the passive ribs (401) of the vermilion seal ink pad (400) is rotated by substantially three quarters of a pitch by a downward movement of the active rib (301) along with a downward movement of the sheathing (300); and a succeeding one of the passive ribs (401) is rotated by substantially a quarter of a pitch by a downward movement of the fitting ribs (501), caused by the urging force of the spring (5) in a process of an upward movement of the sheathing (300).

3. The rotary stamp according to claim 2, comprising an automatic lock mechanism operable to set a locked state where the sheathing (300) is prevented from moving downward when the sheathing (300) is caused to move upward by the urging force of the spring (5).

4. The rotary stamp according to claim 1, comprising an automatic lock mechanism operable to set a locked state where the sheathing (300) is prevented from moving downward when the sheathing (300) is caused to move upward by the urging force of the spring (5).

* * * * *